US007654393B1

(12) United States Patent
Carberry et al.

(10) Patent No.: US 7,654,393 B1
(45) Date of Patent: Feb. 2, 2010

(54) RETAIL DISPLAY INCORPORATING ACCESSORIES WITH PACKAGING

(75) Inventors: Joseph F. Carberry, Cranston, RI (US); Kirk Grathwol, North Providence, RI (US); Rob Dube, Exeter, RI (US); Wayne Losey, Providence, RI (US); Wayne M. Ginn, Narragansett, RI (US)

(73) Assignee: Hasbro, Inc., Pawtucket, RI (US)

( * ) Notice: Subject to any disclaimer, the term of this patent is extended or adjusted under 35 U.S.C. 154(b) by 323 days.

(21) Appl. No.: 11/497,622

(22) Filed: Aug. 2, 2006

Related U.S. Application Data

(60) Provisional application No. 60/761,604, filed on Jan. 24, 2006.

(51) Int. Cl.
*B65D 5/50* (2006.01)
*B65D 23/12* (2006.01)
*B65D 25/54* (2006.01)

(52) U.S. Cl. ..... 206/736; 206/731; 206/776

(58) Field of Classification Search ..... 206/446, 206/485, 577, 769, 770, 775, 736, 523, 524
See application file for complete search history.

(56) References Cited

U.S. PATENT DOCUMENTS 3,406,816 A 10/1968 Green et al.
4,071,064 A * 1/1978 Saul ..... 220/324
4,106,597 A * 8/1978 Shook et al. ..... 190/110
4,700,883 A * 10/1987 Vajtay ..... 229/125.17
4,795,029 A 1/1989 Campbell et al.
4,802,577 A * 2/1989 O'Leary ..... 206/278
4,836,374 A * 6/1989 Hutchins et al. ..... 206/373
5,100,052 A * 3/1992 Vajtay ..... 229/162.4
5,411,140 A * 5/1995 Byer ..... 206/504
5,525,314 A 6/1996 Hurson
6,086,482 A 7/2000 Voden
6,152,303 A * 11/2000 Ducote et al. ..... 206/703
6,241,090 B1 * 6/2001 Kaplinsky ..... 206/315.11
6,622,867 B2 * 9/2003 Menceles ..... 206/771
6,685,018 B1 2/2004 Chuan (Continued)

*Primary Examiner*—Ehud Gartenberg
*Assistant Examiner*—Jose S Stephens, III
(74) *Attorney, Agent, or Firm*—Perry Hoffman

(57) ABSTRACT

A retail display case for retail items such as a doll packaged in a center tubular section with end caps that may be removed from a center tubular section and assembled to form various accessories including a storage case. In addition one or more of the end caps may be used to provide a display stand for the doll. The retail display packaging includes the set of top and bottom end caps, and further includes the center tubular section made from clear plastic or the like. Internal components such as foam pieces or a set of molded plastic sections may be used with molded components for storage and subsequent use from the storage case. The display case is thus convertible from its original retail housing purpose into a storage case or use by the consumer for novel use as an alternative to discarding the packaging. Accordingly, the center section is provided as being disposable. The display assembly includes the set of top and bottom package end caps as molded parts secured to the center tubular section with a set of straps securing the top and bottom molded package end caps thereto. The set of top and bottom molded package caps can be removed from the tubular center section and assembled together with a variety of components and securing devices to form a storage case.

24 Claims, 7 Drawing Sheets

U.S. PATENT DOCUMENTS 6,726,019 B2 4/2004 Leung
6,874,634 B2 * 4/2005 Riley ..... 206/439
6,971,513 B2 * 12/2005 Weinstein et al. ..... 206/321
2003/0226770 A1 * 12/2003 Gelardi et al. ..... 206/1.5
2009/0120835 A1 * 5/2009 Ublacker et al. ..... 206/774

* cited by examiner

RETAIL DISPLAY INCORPORATING ACCESSORIES WITH PACKAGING

CROSS-REFERENCE TO RELATED APPLICATION

This application claims priority pursuant to 35 U.S.C. 119 (e) to U.S. Provisional Application No. 60/761,604, filed on Jan. 24, 2006 which is incorporated herein by reference in its entirety.

BACKGROUND OF THE INVENTION

1. Field of the Invention

The present invention relates to retail display packaging, and more particularly to a retail display case for a doll or other retail items having top and bottom caps and center section components, wherein the cap components may be removed from the center section and assembled into accessories such as a storage case for storing accessories provided as part of a play pattern or alternatively as a display stand.

2. Description of the Related Art

The design of retail display cases has long been known. The display cases are designed with the consumer in mind as to appeal to their interests, whether through appearance or practical use.

Retail display cases have long used a translucent center tubular section as to allow the consumer to see into the packing so to know exactly what they are getting. Retail display cases have also doubled as storage containers in the past. One such method was to make the case out of a soft plastic translucent material and seal the case with a zipper. This method allows the purchaser to use the zipper to gain access to the packaging, remove the retail packaging, and then use the entire package as a reusable carrying case. Additionally, subcompartments can be added to the sidewalls of the package to create divisions in the interior compartment to facilitate the carrying of accessories.

Another method is to make the entire case out of molded plastic with slots on the inside of the case for the product. The molded plastic slots are designed to allow for the items inside the package to remain secure regardless of the package orientation, yet still be able to be removed and replaced easily. This type of packaging is commonly used for toolsets. Additionally, the molded plastic case can have a handle molded into it to make it easier to carry. This creates a secure although bulky carrying case for the product. It would be desirable to create a secure carrying case that is relatively small in comparison to the packaging used while in the retail setting.

It is not believed that a retail display case has been designed as to allow the tubular center section to be removed and the top and bottom caps to be assembled into a storage case. It would be desirable to use such a packaging as the relatively small assembled storage case could store accessories of the doll while also serving as a display stand for it. Additionally, it would be desirable for the small assembled storage case to contain foldable storage units to securely contain accessories. This would allow the accessories to remain secure during transport to avoid chipping or breaking yet remain easy to remove when needed all the while remaining in a relatively small assembled storage case. The invention herein addresses this deficiency of the prior art.

SUMMARY OF THE INVENTION

The present invention provides retail packaging capable of being assembled for advantageous use by the consumer for accessories such as a storage case for storing accessories provided as part of the play pattern in connection with packaged retail items including various toy accessories and/or an action figure doll or the like. The display assembly contains a set of top and bottom molded package end caps, and a center tubular section. The tubular section is open on both ends. One or more foam storage pieces or other piece parts may be provided with the retail item for use with the accessory. To this end, it has not been known previously to provide a display assembly having top and bottom caps, with a center section such that the caps may be removed and assembled together to form a storage case or the like. The piece of foam or other storage material may also be contained within the display assembly as storage material for storing accessories, such as toy action figure weapons, etc. The foam pieces may be provided with openings or perforated slits cut to securely hold accessories that would normally be associated with a packaged item contained within the display assembly.

Alternatively, a set of molded plastic sections may be used to form a folding storage material for accessories that would be normally associated with the packaged item contained within the display assembly. The set of molded plastic sections contain fastener pieces to securely connect to each other and to the top and bottom caps. The set of molded plastic sections are designed in a manner to allow them to fold, bringing together the top and bottom package caps. The set of molded plastic sections may be provided with openings or hooks to securely hold accessories that would normally be associated with a packaged item contained within the display assembly.

The retail display case is thus provided for retail items such as a doll packaged in the center tubular section with end caps that may be removed from a center tubular section and assembled to form, e.g., a storage case or the like. The retail display packaging includes the set of top and bottom end caps, and further includes the center tubular section made from clear plastic or the like. Internal components such as foam pieces may be used with molded components for storage and subsequent use from the storage case. The display case is thus convertible from its original retail housing purpose into a storage case or use by the consumer for novel use as an alternative to discarding the packaging. Attachment components may be provided for use with the end cap portions to form the storage case, etc.

In addition one or more of the end caps may be used to provide a display stand for the doll. In another embodiment of the present invention, the top molded package cap may be provided alternatively with a set of foot pegs molded into the design. Once the storage case is assembled, it then doubles as a display stand by having a packaged item fit securely into the set of foot pegs.

Briefly summarized, the present inventions relate to methods and packaging for displaying retail items contained in a display package. The display package includes at least one of top or bottom package cap in a shape consistent with an accessory associated with the retail item, and a tubular center section is provided. The top and/or the bottom package cap are fastened to the tubular center section such that at least one of the top or bottom package cap can be removed from the tubular center section and assembled for use with the retail item as the accessory associated with the retail item.

BRIEF DESCRIPTION OF THE DRAWINGS

The invention will now be more particularly described by way of example with reference to the accompanying drawings. The invention advantages may be best understood from the following detailed description taken in conjunction with the drawing figures, in which.

DETAILED DESCRIPTION OF THE PREFERRED EMBODIMENTS

Figure 1:
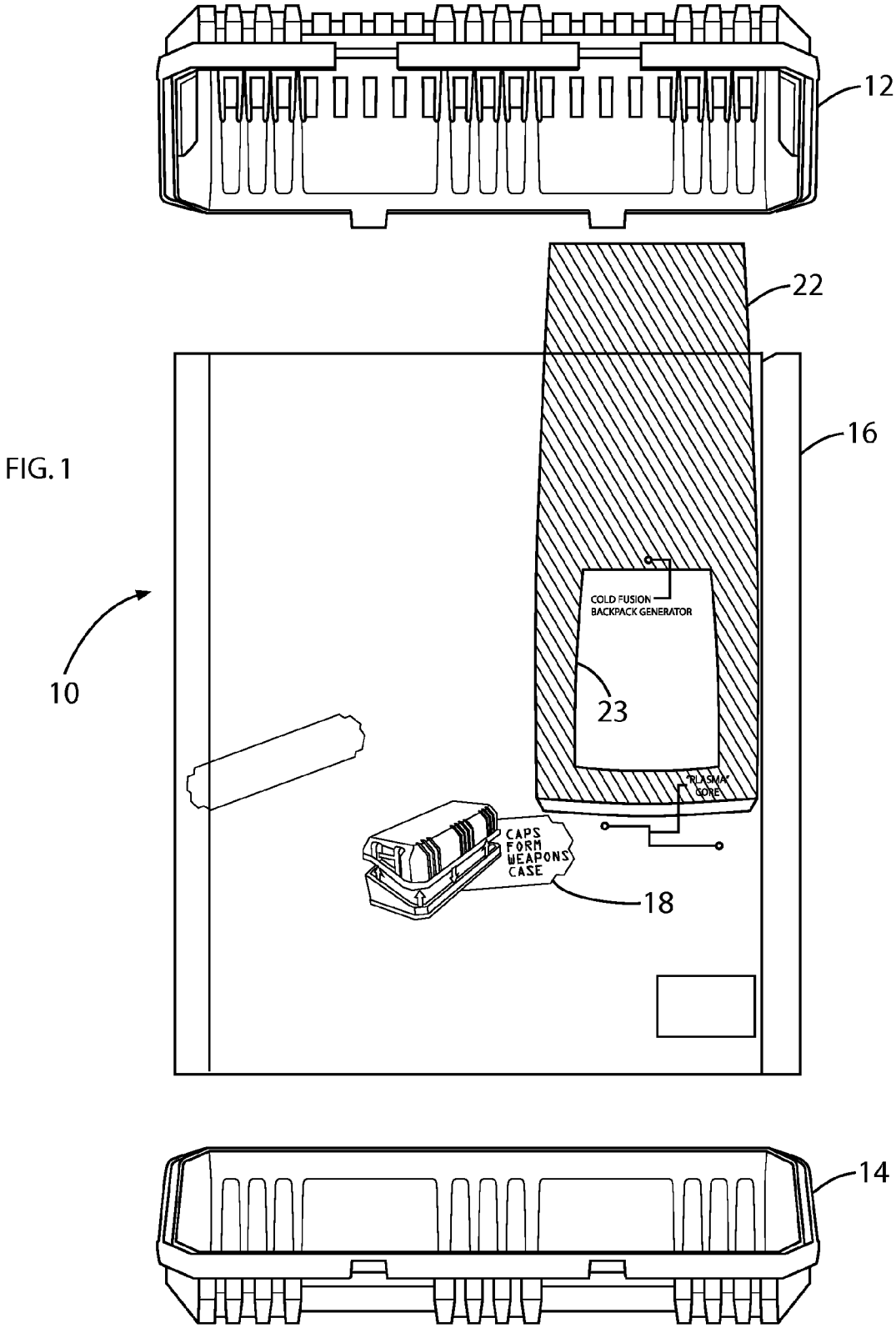
FIG. 1 illustrates an exploded view of the display assembly according to an embodiment of the invention.
Figure 2A:
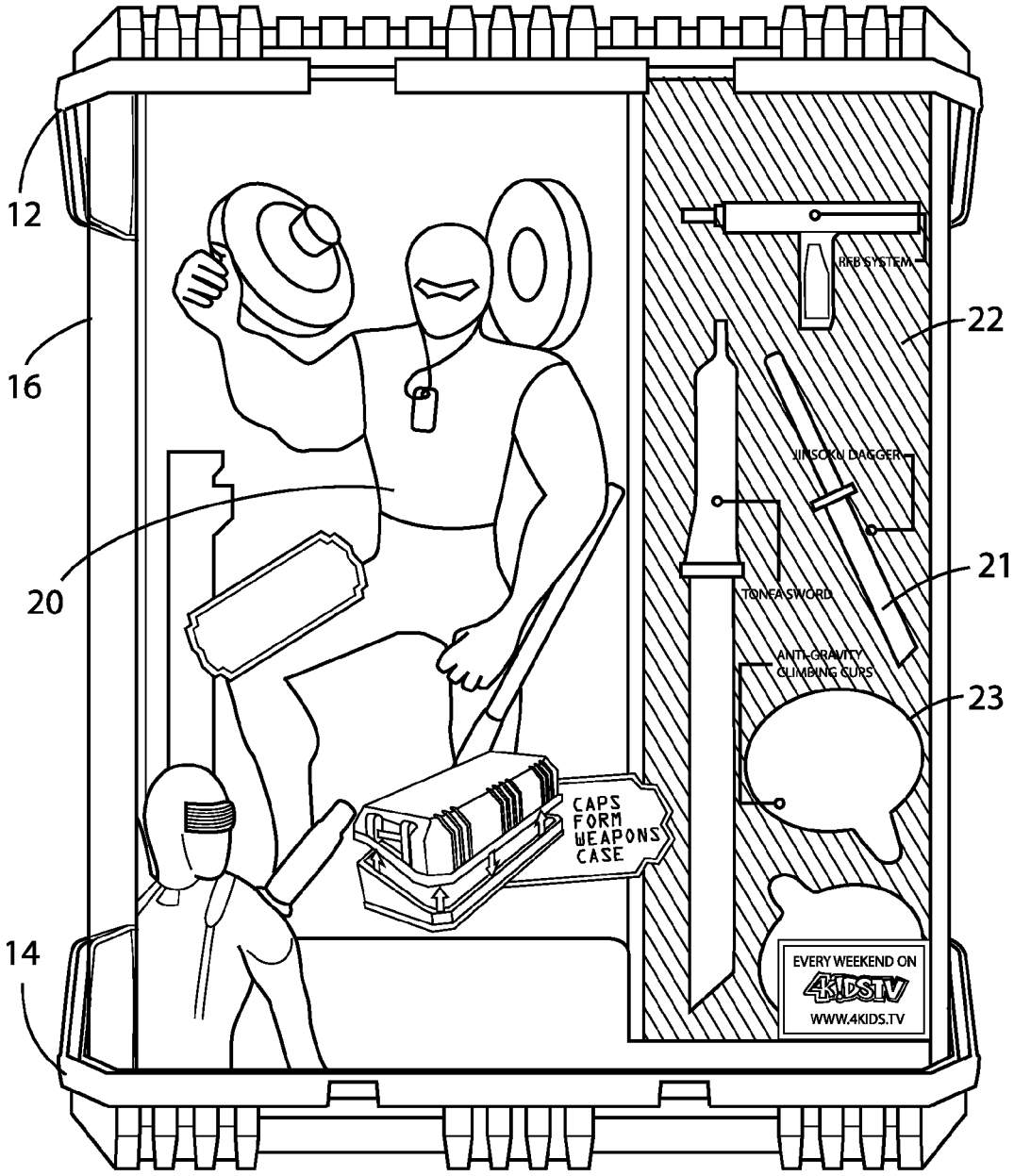
FIGS. 2A and 2B are assembled front and perspective assembled views of the display assembly packaging of FIG. 1.

With reference to FIGS. 1, 2A and B, a display assembly 10 is illustrated incorporating accessories with retail packaging in accordance with the present invention. The display package includes at least one of a top end cap 12 or bottom end cap 14 package caps in a shape consistent with an accessory (discussed in connection with reference numeral 30 below) associated with the retail item, doll 20. The set of top and bottom end caps 12, 14 are molded plastic or similar material and a molded design or indicia may be incorporated with the molded material of the top cap 12 or bottom end cap 14 as to correspond to a packaged items contained in the display assembly 10. A center tubular section 16 is provided and the top and/or the bottom package caps 12, 14 are fastened to the tubular center section such that at least one of the top or bottom package caps 12, 14 can be removed from the tubular center section and assembled for use with the retail item 20 as the accessory 30 associated with the retail item. The center tubular section 16 also may be provided with indicia 18 thereon as generally associated with the retail item 16.

FIG. 1 shows an exploded assembly view of the display assembly 10 as retail packaging capable of being assembled into product for packaging retail items such as the doll 20 or the like. The tubular center section 16 is open on both ends and provided as transparent or translucent for viewing of the doll 20 and associated accessories 21 therein (see FIG. 2A). Any material may be used but the translucent material allows items contained in the display assembly 10 to be viewable. The tubular center section 16 may be made from clear plastic or the like. One or more foam storage pieces or other piece parts may be provided as storage material 22 for use with retail items 20, 21 (i.e., doll 20 and accessories 21 that would normally be associated as packaged items contained within the display assembly 10).

The piece of foam or other storage material 22 may also be contained within the display assembly as storage material for storing the accessories 21, such as toy action figure weapons, etc. The foam pieces storage material 22 may be provided with openings 23, perforated slits or the like cut therein to securely hold the accessories 21. Thus the storage material 22 are provided with the openings 23 or perforated slits cut to securely hold accessories 21 that would normally be associated with the packaged item, doll 20 contained within the display assembly 10. The foam storage material 22 or other storage material may also be contained within the display assembly 10 for presentation of the toy action figure doll 20, weapon accessories 21, etc. for retail display at the point of sale.

Figure 6D:
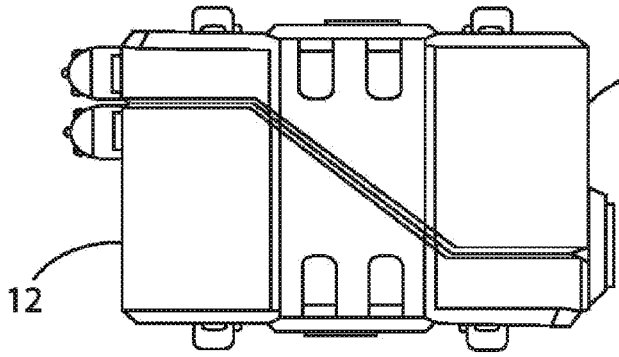
FIGS. 6A-6D illustrate the design of the set of molded plastic sections and the assembly of the set of molded plastic sections into the storage case.
Figure 5:
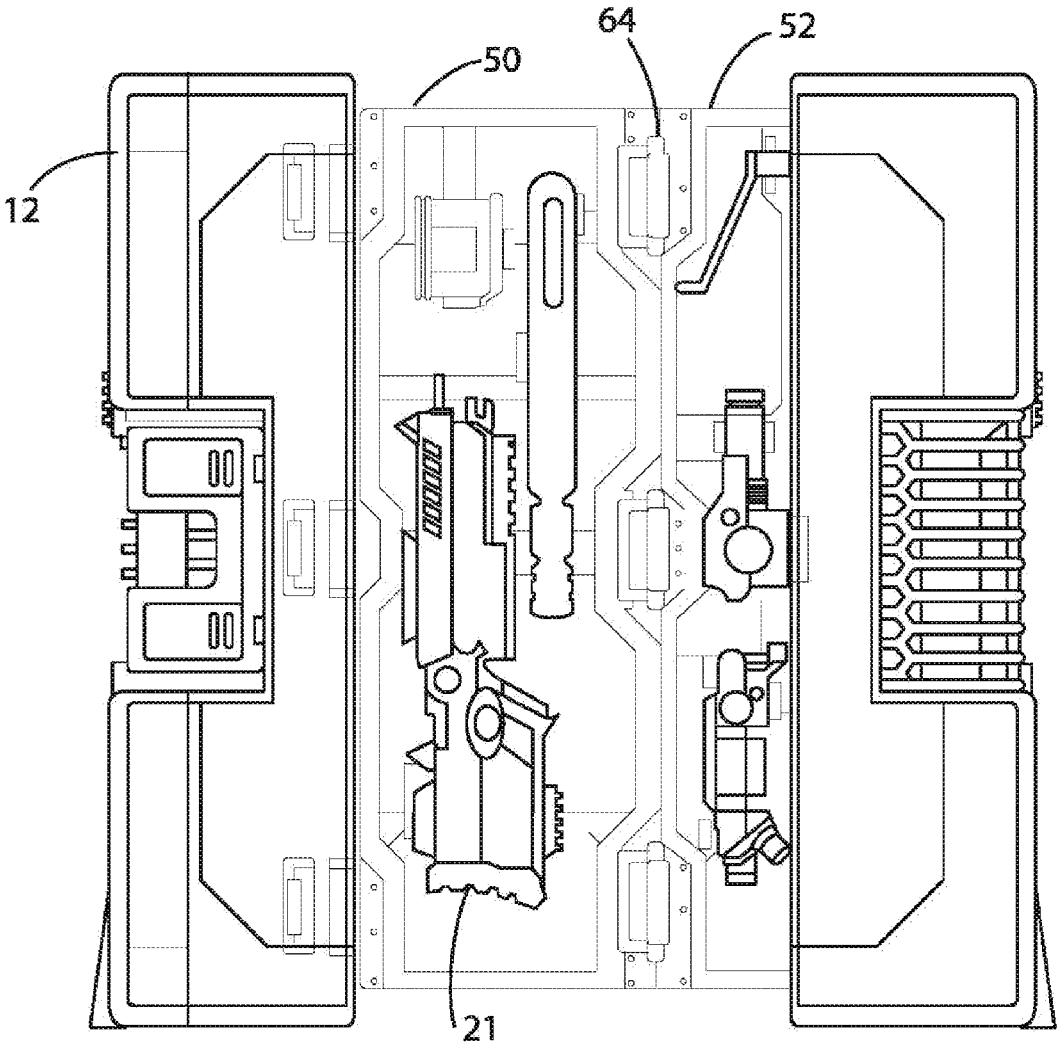
FIG. 5 illustrates the set of molded plastic sections used to secure accessories of the packaged retail item.
Figure 6A:
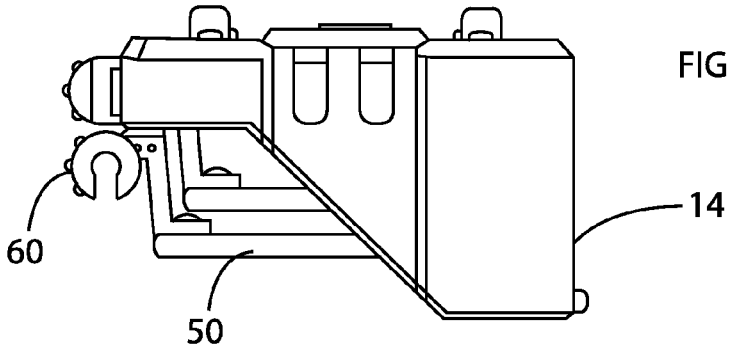
Figure 6B:
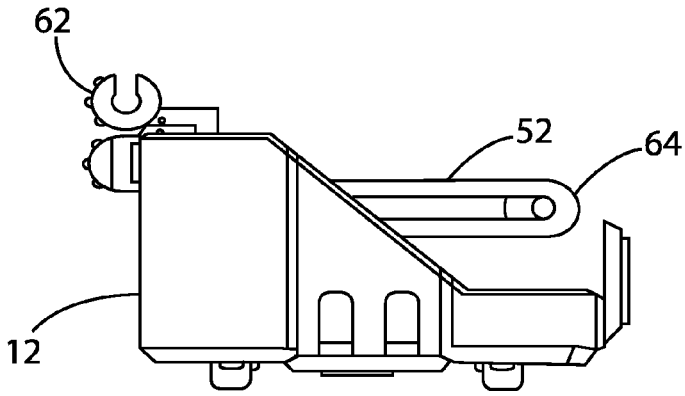
Figure 6C:
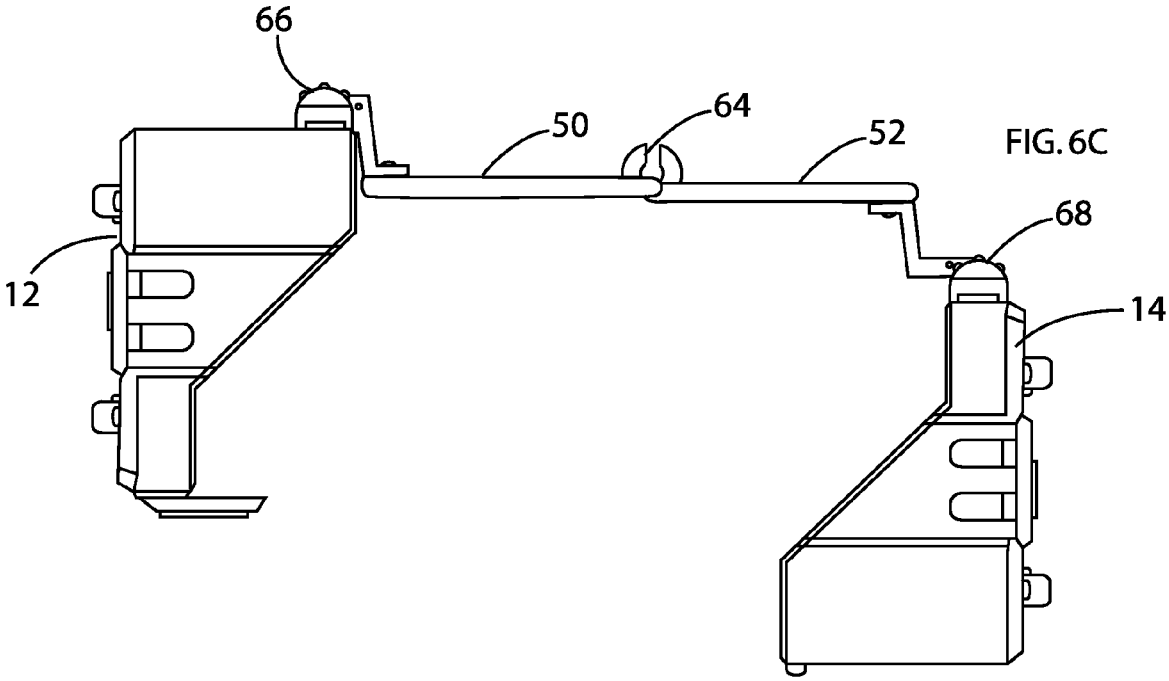

In an alternative embodiment, as shown in FIG. 5, a set of molded plastic sections 50, 52 is used as storage material for storing accessories 21 in lieu of the piece of foam 22. The molded plastic sections 50, 52 are designed to securely store accessories related to the item contained in the retail package. The molded plastic sections 50, 52 should be designed to hold the accessories 21 so that during transport they will remain securely mounted to the molded plastic sections 50, 52 but should also allow a child to be able to easily remove the accessories 21 from the molded plastic sections 50, 52 when necessary. This design achieves the goals of avoiding chipping or breaking of accessories 21 during transport while maintaining accessibility of the accessories 21 to the target consumer group. With reference to FIGS. 6A, 6B and 6C, and as shown in FIG. 6A, the set of molded plastic sections 50, 52 are designed with crescent shaped plastic fasteners 60, 62 to allow them to securely connect to a rounded plastic bar while still being pivot around the rounded plastic bar. On one of the set of molded plastic sections 50, one of the ends is a rounded plastic bar. As shown in FIG. 6B, this configuration allows the crescent shaped plastic fastener 60, 62 of one of the molded plastic section 52 to connect to the other molded plastic section 50 so that the set of molded plastic sections are able to fold and unfold along the pivot joint 64 while remaining securely connected. As shown in FIG. 6C, the ends of the set of molded plastic sections 66, 68 are able to connect to the top and bottom molded package caps 12, 14. The connection at the ends of the molded plastic sections 66, 68 is the same as the connection made at the pivot point 64, that is the crescent shaped plastic fasteners 60, 62 connect to a rounded plastic bar located on the top and bottom molded package caps 12, 14. This allows the set of molded plastic sections 50, 52 to fold and unfold at the ends 66, 68, while remaining secure to the top and bottom molded package caps 12, 14. As shown in FIG. 6D, this configuration results in the top and bottom molded package caps 12, 14 fitting securely as a storage case with the set of molded plastic sections folded inside securely holding any accessories.

Additionally, as illustrated in FIG. 6A, the molded plastic sections 50, 52, should be designed in a manner so that when they are fully and properly connected to the top and bottom molded package caps 12, 14 the storage case is able to stand and remain balanced on the sides of the top and bottom molded package caps so that the molded plastic sections 50, 52 and the accessories 21 are visible to the consumer. This allows the presentation of the accessories 21 in an attractive way and the molded plastic sections may be tailored to make the presentation of accessories 21 more applicable to the retail product. For example, as shown in FIG. 6A, the molded plastic sections 50, 52 are designed to emulate an arsenal wall to correspond to the accessories 21 of a military action figure. This tailored presentation gives the product more appeal to the consumer.

Figure 2B:
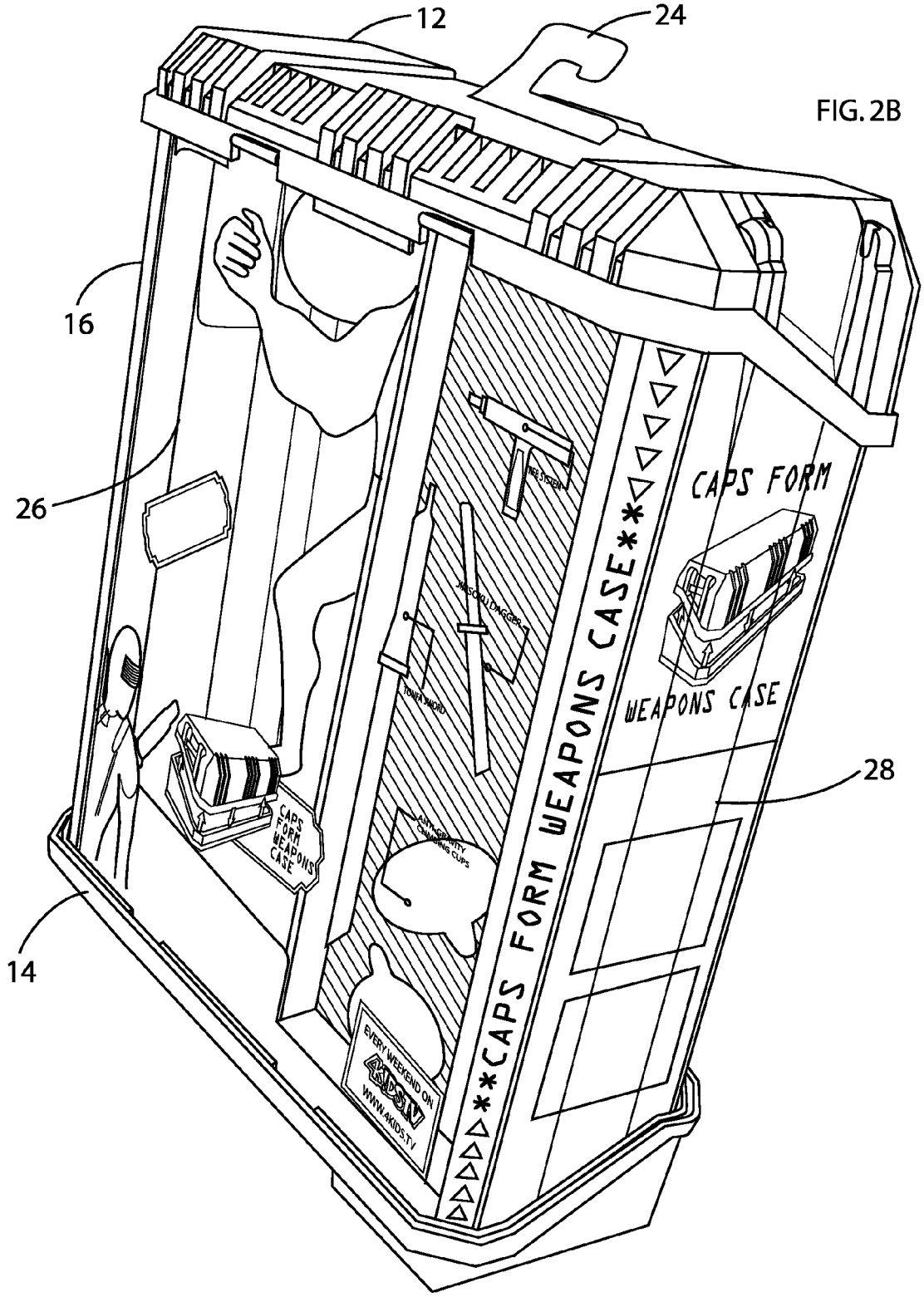

As shown in FIG. 2B, detachable loop, card or hook 24 receivable with the top package cap 12 allows the display assembly 10 to be hung or supported, wherein the detachable hook 24 supports the display package in a retail display setting. A set of straps 26, 28 made of plastic or other materials secures the set of top and bottom molded package caps 12, 14 to the tubular center section 16. The set of straps 26, 28 secure the set of top and bottom molded package caps 12, 14 to the tubular center section 16 using material strong enough to secure the set of top and bottom molded package caps 12, 14 to the tubular center section 16 as to form secure packaging for retail distribution.

Figure 3B:
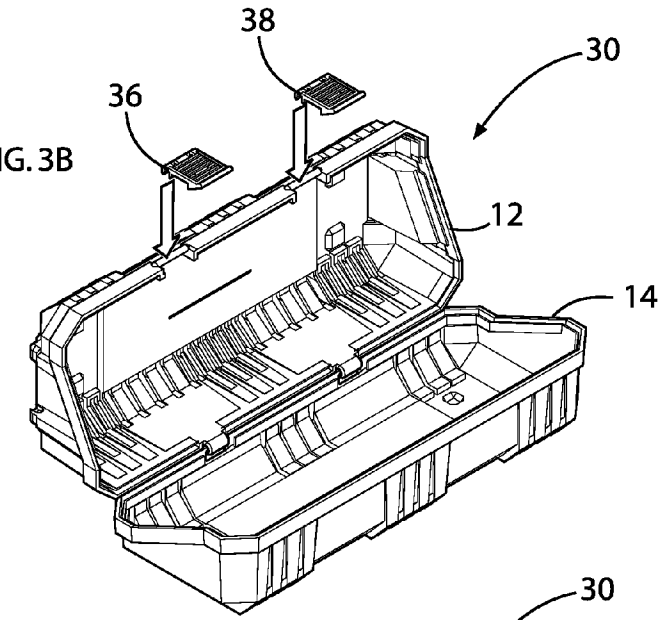
FIGS. 3A-3D illustrate the assembly of storage case accessories that are configured for use in accordance with the disclosed inventions.
Figure 3A:
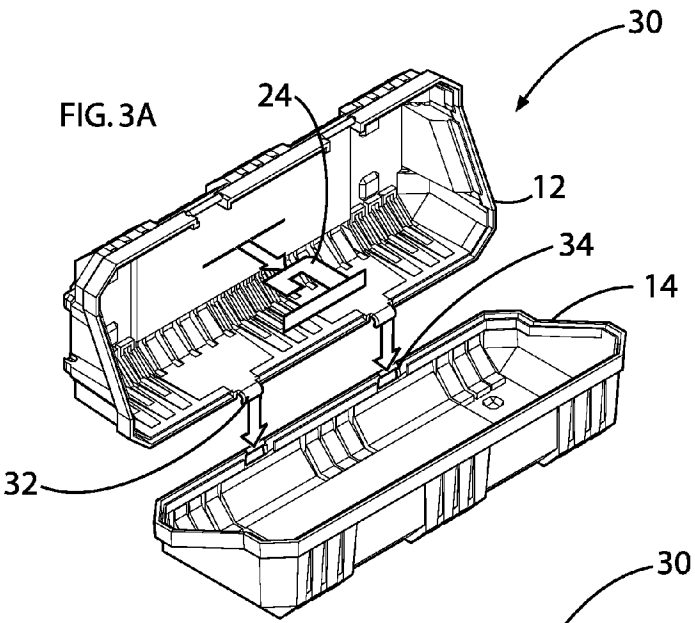

FIGS. 3A-3D illustrate the assembly of a storage case 30 with accessories that are configured for use therewith. Internal components and storage materials such as one or more foam pieces may be used with molded components for storage and subsequent use from the storage case. The display case is thus convertible from its original retail housing purpose into a storage case or use by the consumer for novel use as an alternative to discarding the packaging. Attachment components may be provided for use with the end cap portions to form the storage case, etc. The method for assembling the display assembly 10 into storage case 30, in FIG. 3A illustrates removing the detachable loop, card or hook 24 from the top package end cap 12, and configuring the removed set of top and bottom molded package caps 12, 14 from the display assembly 10 for being attached at hinge fastener portions 32, 34 thereat attaching the set of top and bottom molded package caps 12, 14 together to form the storage case 30. In FIG. 3B, the initial attachment of accessories to the storage case is illustrated by attaching a set of latches 36, 38 to the storage case 30 to securely lock the storage case 30 when assembled. A variety of securing devices may be used to securely fasten the set of top and bottom molded package end caps 12, 14 to one another. The set of top and bottom molded package end caps 12, 14 contain the fasteners so that the top and bottom molded package caps will fit together securely as storage case 30 swings open.

The display assembly comes with a set of latches that may be attached to the assembled storage device to secure it from swinging open. FIG. 3C shows the assembly together with the piece of foam as storing material 22 inserting the piece of foam 22 into the storage case 30. Accordingly the foam storage material 22 is provided with the openings 23, perforated slits or the like cut therein to securely hold the accessories 21 normally be associated with the packaged retail items. The foam storage material 22 or other storage material may also be contained within the display assembly 10 for presentation of the toy action figure doll 20, weapon accessories 21, etc. The foam storage material 22 is cut to fit inside the assembled storage case.

Figure 3D:
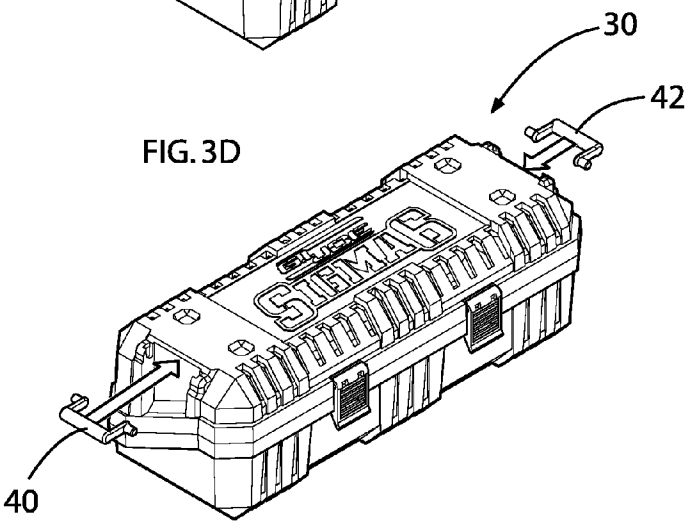
Figure 3C:
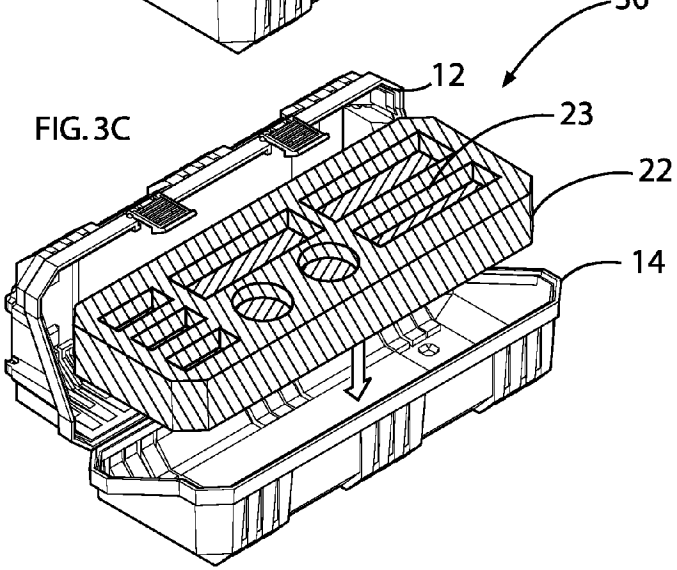

As shown in FIG. 3D, the display assembly also comes with a set of handles 40, 42 that snap onto the top molded package end cap 12. The method for assembling thus includes attaching accessories to the storage case to give the storage case 30 a look such that it may be carried by the action figure or doll when assembled.

Figure 4:
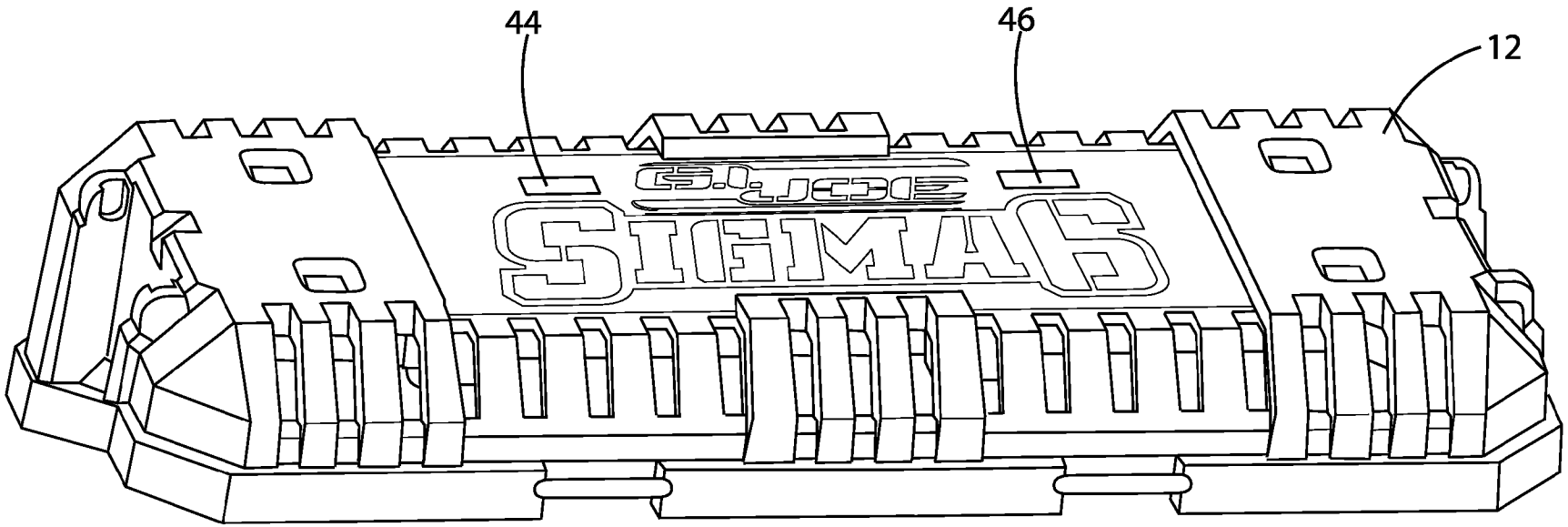
FIG. 4 shows a top view of a molded package cap for providing a display stand for the packaged retail item in accordance with an alternative aspect the invention.

With reference to FIG. 4, the top molded package end cap 12 is shown in an alternative embodiment to include a molded design that further contains slot or peg attachable moldings 44, 46 therein such that the set of top and/or bottom molded package end caps 12, 14 may be used as a display stand, and contain foot pegs for display purposes.

It should be appreciated that a wide range of changes and modifications may be made to the embodiments of the inventions as described herein. It is intended that the foregoing detailed description be regarded as illustrative rather than limiting. While there have been illustrated and described particular embodiments of the inventions, it will be appreciated that numerous changes and modifications will occur to those skilled in the art, and it is intended in the appended claims to cover those changes and modifications which fall within the true spirit and scope of the present invention.

What is claimed is:

1. A display package for a retail item comprising:

a top package cap;

a bottom package cap;

a fastener securing said top package cap and said bottom package cap;

a retail item within the package;

a tubular center section allowing the retail item contained therein to be viewed, together the top package cap, the bottom package cap and the tubular center section constituting a display package; and, the retail item further comprising a plurality of parts and storage material having openings for storing the parts as accessories to the retail item, with one or more securing devices attached at the top and bottom package caps when the tubular section is removed;

wherein when the tubular center section is removed from the display package, the top package cap connects with the bottom package cap constituting a storage case for assembly together, said storage case being provided for accessories associated with the retail item, and said top package cap and said bottom package cap being provided in a shape consistent for use together.

2. The display package of claim 1, wherein at least one of the top or bottom package caps comprise a molded design relating to the retail item.

3. The display package of claim 1, where the set of top and bottom package caps comprises a molded design as to contain foot pegs or a slot there in such that at least one of the top or bottom package caps receives an item display.

4. The display package of claim 1, wherein at least one of the top or bottom package caps receives the retail item for use as a display stand for the retail item.

5. The display package of claim 1, where the tubular center section comprises a transparent material allowing the retail item contained therein to be viewed.

6. The display package of claim 1, wherein the fastener securing the top and bottom package caps to the tubular center section comprise a strap for securing with the tubular center section, with a material strong enough to secure the top and bottom package caps to the tubular center section as to form a secure package for retail distribution.

7. The display package of claim 1, wherein the storage material comprises a piece of foam comprising openings to hold one or more of the plurality of parts.

8. The display package of claim 1, wherein the plurality of securing devices comprises a set of latches designed to securely connect the of top and bottom package caps.

9. The display package of claim 1, wherein the plurality of securing devices comprises a set of handles.

10. The display package of claim 1, wherein the top and bottom package caps comprise openings defined therein and the fastener securing the top and bottom package caps to the center section comprise a strap received at the openings of the top and bottom package caps for securing with the center section, said strap comprising a material strong enough to secure the top and bottom package caps to the center section as to form a secure package for retail distribution.

11. The display package of claim 1, wherein the one or more securing devices comprises a set of molded plastic sections comprising openings to hold one or more of the plurality of parts.

12. The display package of claim 11, wherein the set of molded plastic sections comprise fastening pieces designed to securely connect the set of molded plastic sections and the top and bottom package caps so that the molded plastic sections are able to fold bringing together the top and bottom package caps forming an accessory storage case.

13. A display package for a retail item comprising:

a top package cap;

a bottom package cap;

a fastener securing said top package cap and said bottom package cap;

a tubular center section;

a retail item within the package comprising a plurality of parts and storage material having openings for storing the parts as accessories to the retail item, with one or more securing devices attached at the top and bottom package caps when the tubular section is removed; and, the tubular center section allowing the retail item contained therein to be viewed, together the top package cap, the bottom package cap and the tubular center section constituting a display package;

wherein the top package cap connects with the bottom package cap constituting a storage case for said accessories associated with the retail item, said top package cap and said bottom package cap being provided in a shape consistent for assembly together.

14. The display package of claim 13, wherein a portion of said tubular center section comprises a transparent material.

15. The display package of claim 13, wherein the top and bottom package caps comprise openings defined therein and the fastener securing the top and bottom package caps to the center section comprise a strap received at the openings of the top and bottom package caps for securing with the center section, said strap comprising a material strong enough to secure the top and bottom package caps to the center section as to form a secure package for retail distribution.

16. The display package of claim 13, wherein at least one of the top or bottom package caps receives the retail item for use as a display stand for the retail item.

17. The display package of claim 13, where the tubular center section comprises a transparent material allowing the retail item contained therein to be viewed.

18. The display package of claim 13, wherein the retail item within the package comprises a plurality of parts and storage material having openings for storing the parts as accessories to the retail item, with one or more securing devices and the top and bottom package caps wherein the one or more securing devices comprises a set of latches designed to securely connect the of top and bottom package caps.

19. The display package of claim 18, wherein the plurality of securing devices comprises a set of handles.

20. The display package of claim 19, wherein the set of molded plastic sections comprise fastening pieces designed to securely connect the set of molded plastic sections and the top and bottom package caps so that the molded plastic sections are able to fold bringing together the top and bottom package caps forming an accessory storage case.

21. A display package with separable storage case assembly comprising:

a top package cap;

a bottom package cap;

a tubular center section;

a retail item including a plurality of parts and storage material having openings for storing the parts and accessories associated with the retail item, with one or more securing devices attached at the top and bottom package caps when the tubular center section is removed, said retail item being provided within the display package with at least a portion of the retail item being viewable through the tubular center section, said tubular center section containing the retail item therein, with each of said top package cap and said bottom package cap being configured in a shape consistent with a separate storage case assembly associated with the retail item;

a fastener securing said top package cap and said bottom package cap to the tubular center section; and wherein each of said top package cap and said bottom package cap are removable from the tubular center section and assembled together with said top package cap attached to said bottom package cap for use with the retail item as the separate storage case assembly, with said top package cap and said bottom package cap configured for receiving and enclosing the accessories for storage within the separate storage case assembly.

22. The display package of claim 21, wherein the fastener securing the top and bottom package caps to the tubular center section comprise a strap for securing with the tubular center section, with a material strong enough to secure the top and bottom package caps to the tubular center section as to form a secure package for retail distribution, wherein at least one of the top or bottom package caps comprise molded design indicia relating to the retail item.

23. A display package with separable storage case assembly comprising:

a top package cap;

a bottom package cap, said top package cap and said bottom package cap being molded from molded plastic in a shape consistent for use together;

a tubular center section having the top package cap and the bottom package cap attached to said tubular center section;

a retail item and accessories associated with the retail item, said retail item provided within the display package with at least a portion of the retail item being viewable through the tubular center section, said tubular center section containing the retail item therein;

a fastener securing said top package cap and said bottom package cap to the tubular center section wherein said top package cap and said bottom package cap can be removed from the tubular center section and assembled for use;

a storage case consisting of the top package cap and the bottom package cap removed from said tubular center section, said top package cap and said bottom package cap being assembled for use to contain accessories associated with the retail item; and wherein the retail item within the package comprises storage material having openings for storing the parts as accessories to the retail item, with one or more securing devices attached at the top and bottom package caps when the tubular section is removed wherein the one or more securing devices comprises a set of latches designed to securely connect the of top and bottom package caps.

24. The display package of claim 23, wherein the set of molded plastic sections comprise fastening pieces designed to securely connect the set of molded plastic sections and the top and bottom package caps so that the molded plastic sections are able to fold bringing together the top and bottom package caps forming an accessory storage case.

* * * * *